US007202603B2

(12) United States Patent
Hatanaka et al.

(10) Patent No.: US 7,202,603 B2
(45) Date of Patent: Apr. 10, 2007

(54) PLASMA DISPLAY PANEL COMPRISING ULTRAVIOLET-TO-VISIBLE RAY CONVERTER

(75) Inventors: Hidekazu Hatanaka, Gyeonggi-do (KR); Gi-young Kim, Chungcheongbuk-do (KR); Seung-hyun Son, Gyeonggi-do (KR); Kyung-jun Hong, Jeollanam-do (KR)

(73) Assignee: Samsung SDI Co., Ltd., Suwon-Si, Gyeonggi-do (KR)

( * ) Notice: Subject to any disclaimer, the term of this patent is extended or adjusted under 35 U.S.C. 154(b) by 281 days.

(21) Appl. No.: 10/769,845

(22) Filed: Feb. 3, 2004

(65) Prior Publication Data

US 2004/0160185 A1 Aug. 19, 2004

(30) Foreign Application Priority Data

Feb. 14, 2003 (KR) ..... 10-2003-0009414

(51) Int. Cl.
*H01J 17/49* (2006.01)
*H01J 61/40* (2006.01)
*H01K 1/26* (2006.01)

(52) U.S. Cl. ..... 313/582; 313/110; 313/112

(58) Field of Classification Search ..... 313/582–587, 313/110, 112

See application file for complete search history.

(56) References Cited

U.S. PATENT DOCUMENTS 6,737,805 B2 * 5/2004 Nakada et al. ..... 313/582
6,762,566 B1 * 7/2004 George et al. ..... 315/169.3
6,879,106 B2 * 4/2005 Lee ..... 313/586
2003/0146687 A1 * 8/2003 Ono et al. ..... 313/486

FOREIGN PATENT DOCUMENTS

JP 5-121002 5/1993
JP 09283030 A * 10/1997

OTHER PUBLICATIONS

Korean Application No. 10-2003-0009414 and Office Action issued by the Korean Patent Office on Feb. 22, 2005.

* cited by examiner

*Primary Examiner*—Nimeshkumar D. Patel
*Assistant Examiner*—Anne M Hines
(74) *Attorney, Agent, or Firm*—Buchanan Ingersoll & Rooney PC

(57) ABSTRACT

A plasma display panel (PDP) that has an ultraviolet ray converter. The plasma display panel includes a front panel, a rear panel, a filter set, and an optical converter. The filter set is installed in front of the front panel. The optical converter is installed between the front panel and the filter set and converts ultraviolet rays emitted from the front panel into visible rays. Accordingly, the ultraviolet rays emitted from a plasma forming area in a discharge cell are mostly converted into visible rays. Therefore, the efficiency of the PDP is improved.

9 Claims, 10 Drawing Sheets

PLASMA DISPLAY PANEL COMPRISING ULTRAVIOLET-TO-VISIBLE RAY CONVERTER

BACKGROUND OF THE INVENTION

This application claims the priority of Korean Patent Application No. 2003-9414, filed on Feb. 14, 2003, in the Korean Intellectual Property Office, the disclosure of which is incorporated herein in its entirety by reference.

1. Field of the Invention

The present invention relates to planar display devices, and more particularly, to a plasma display panel (hereinafter, referred to as PDP) comprising an ultraviolet-to-visible ray converter.

2. Description of the Related Art

PDPs are planar image display devices, in which a gas, such as Ne+Xe, is injected into a space that is defined by a front glass substrate, a rear glass substrate, and partitions between the front and rear glass substrates, ultraviolet (UV) rays emitted from Xe gas due to application of a voltage to anodes and cathodes are converted into visible rays by using fluorescent substances, and the visible rays are used as display rays.

PDPs can be the most easily enlarged, among planar displays, such as liquid crystal displays (LCDs), field emission displays (FEDs), and electro-luminescence displays (ELDs).

PDPs are anticipated to have a high luminance and a high luminous efficacy, by plasma production due to the employment of an efficient electrode structure and an efficient driving circuit, by an improvement in the efficiency of UV emission from plasma, by an improvement in the efficiency of conversion of visible rays by fluorescent substances, and by other measures.

FIG. 1 is an exploded perspective view of a conventional AC type PDP. Referring to FIG. 1, the conventional AC type PDP includes a front glass substrate 10 and a rear glass substrate 12, which faces the front glass substrate 10 in parallel. A filter set 30 is installed over the front glass substrate 10 and blocks off infrared rays (IR), electromagnetic interference (EMI), and the like that are emitted from the PDP. The filter set 30 is comprised of black stripe areas 32*a* and filtering areas 32*b*. The filtering areas 32*b* receive and filter out filtering elements, such as, IR or EMI generated from discharge cells. The black stripe areas 32*a* correspond to barrier ribs 26 to be described later, in a one-to-one correspondence, and prevent the filtering elements generated from a discharge cell from being introduced into another discharge cell. First and second discharge sustaining electrodes 14*a* and 14*b* are arranged in parallel on a surface of the front glass substrate 10 that faces the rear glass substrate 12. The first and second discharge sustaining electrodes 14*a* and 14*b* are transparent. As shown in FIG. 2, there is a gap (d) between the first and second discharge sustaining electrodes 14*a* and 14*b*. A first bus electrode 16*a* is formed on the first discharge sustaining electrode 14*a*, and a second bus electrode 16*b* is formed on the second discharge sustaining electrode 14*b*. The first and second bus electrodes 16*a* and 16*b* prevent a voltage from being lowered by a resistance during discharge. The first and second discharge sustaining electrodes 14*a* and 14*b* and the first and second bus electrodes 16*a* and 16*b* are covered with a first dielectric layer 18, which is covered with a protective film 20. The protective film 20 protects the first dielectric layer 18, which is weak to discharge, so that the PDP can stably operate for a long period of time. Also, the protective film 20 lowers a discharge voltage by emitting secondary electrons in great quantities during discharge. A magnesium oxide (MgO) film is widely used as the protective film 20.

Address electrodes 22 for addressing pixels are installed on the rear glass substrate 12. Since one address electrode 22 is included in one discharge cell, one pixel has three address electrodes 22. The address electrodes 22 are parallel to one another and perpendicular to the first and second discharge sustaining electrodes 14*a* and 14*b*. A second dielectric layer 24, with which the address electrodes 22 are covered, is formed on the rear glass substrate 12 and performs a light reflection. A plurality of barrier ribs 26 are arranged at regular intervals on the second dielectric layer 24. More specifically, the barrier ribs 26 are placed on portions of the second dielectric layer 24 that exist between adjacent address electrodes 22. From the viewpoint of the second dielectric layer 24, the address electrodes 22 alternate with the barrier ribs 26. The barrier ribs 26 adhere to the protective film 20 on the front glass substrate 10 while the front and rear glass substrates 10 and 12 are joining. Fluorescent layers 28*a*, 28*b*, and 28*c* are coated between adjacent barrier ribs 26 such as to cover the portions of the second dielectric layer 24 defined therebetween and lateral surfaces of the barrier ribs 26. The first, second, and third fluorescent layers 28*a*, 28*b*, and 28*c* are excited by UV rays and thus emit red (R), green (G), and blue (B) light, respectively.

FIG. 3 is a cross-section of a unit discharge cell of the PDP, taken in a direction perpendicular to the address electrodes 22. In FIG. 3, reference character A1 denotes UV rays with 147 nm and 173 nm wavelengths that are emitted from a plasma forming area 32 and projected toward the fluorescent layers 28*a*, 28*b*, and 28*c*. The rays A1 are referred to as first UV rays hereinafter. Reference character A2 denotes visible rays emitted from the fluorescent layers 28*a*, 28*b*, and 28*c* excited by the first UV rays A1, while the fluorescent layers are being stabilized. Reference character A3 denotes UV rays with 147 nm and 173 nm wavelengths that are emitted in the direction opposite to the direction of emission of the first UV rays A1. The rays A3 are referred to as second UV rays hereinafter.

As shown in FIG. 3, in a conventional PDP, some of the UV rays emitted from the plasma forming area 32 within a cell, that is, the second UV rays A3, are absorbed by the front glass substrate 10. In other words, in a conventional PDP, the fluorescent layers 28*a*, 28*b*, and 28*c* are excited not by most of the UV rays emitted from the plasma forming area 32 but by only some of the UV rays.

The visible rays emitted from the fluorescent layers 28*a*, 28*b*, and 28*c* increase in proportion to the number of UV rays projected onto the fluorescent layers 28*a*, 28*b*, and 28*c*. As described above, in a conventional PDP, since the number of UV rays projected onto the fluorescent layers 28*a*, 28*b*, and 28*c* is restricted, the number of visible rays emitted from the fluorescent layers 28*a*, 28*b*, and 28*c* is also restricted. As a result, the luminance and efficiency of a conventional PDP are lowered.

SUMMARY OF THE INVENTION

The present invention provides a PDP that can use UV rays emitted from a cell in order to improve the luminance.

According to an aspect of the present invention, there is provided a plasma display panel including a front panel, a rear panel, and a filter set which is installed in front of the front panel. The plasma display panel also includes an optical converter which is installed between the front panel and the filter set and converts ultraviolet rays emitted from the front panel into visible rays.

The optical converter is attached to a front surface of the front panel or the back of the filter set. The optical converter is a fluorescent plate having a predetermined thickness.

Preferably, the fluorescent plate is formed of a fluorescent material that is able to convert ultraviolet rays with a wavelength of more than 330 nm into visible rays.

It is preferable that the fluorescent plate has a thickness that enables the amount of visible rays emitted from the front panel to be greater than the amount of visible rays lost while passing through the fluorescent plate.

The fluorescent plate is formed by combining red, green, and blue fluorescent plates that emit red, green, and blue visible rays, respectively, into which the ultraviolet rays are converted.

When the thickness of the fluorescent plate is t, the thickness of the red fluorescent plate is in the range of 0 μm<t<35 μm, preferably, in the range of 5 μm≦t<35 μm, the thickness of the green fluorescent plate is in the range of 0 μm<t<36 μm, preferably, in the range of 5 μm≦t<36 μm, and the thickness of the blue fluorescent plate is in the range of 0 μm<t<37 μm, preferably, in the range of 5 μm≦t<37 μm. The thickness of each of the red, green, and blue fluorescent films may be identical to or different from one another.

The red fluorescent plate is an $Y_2O_2S$:Eu plate, and the green and blue fluorescent plates are BAM plates.

A plasma source gas that emits ultraviolet rays with a wavelength of more then 330 nm exists in a discharge region between the front and rear panels, and a side of the rear panel that is exposed to the discharge region is covered with a fluorescent film that is excited by the ultraviolet rays and emits visible rays.

Accordingly, the ultraviolet rays emitted from a plasma forming area in a discharge cell are mostly converted into visible rays. Therefore, the efficiency of the PDP is naturally improved.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
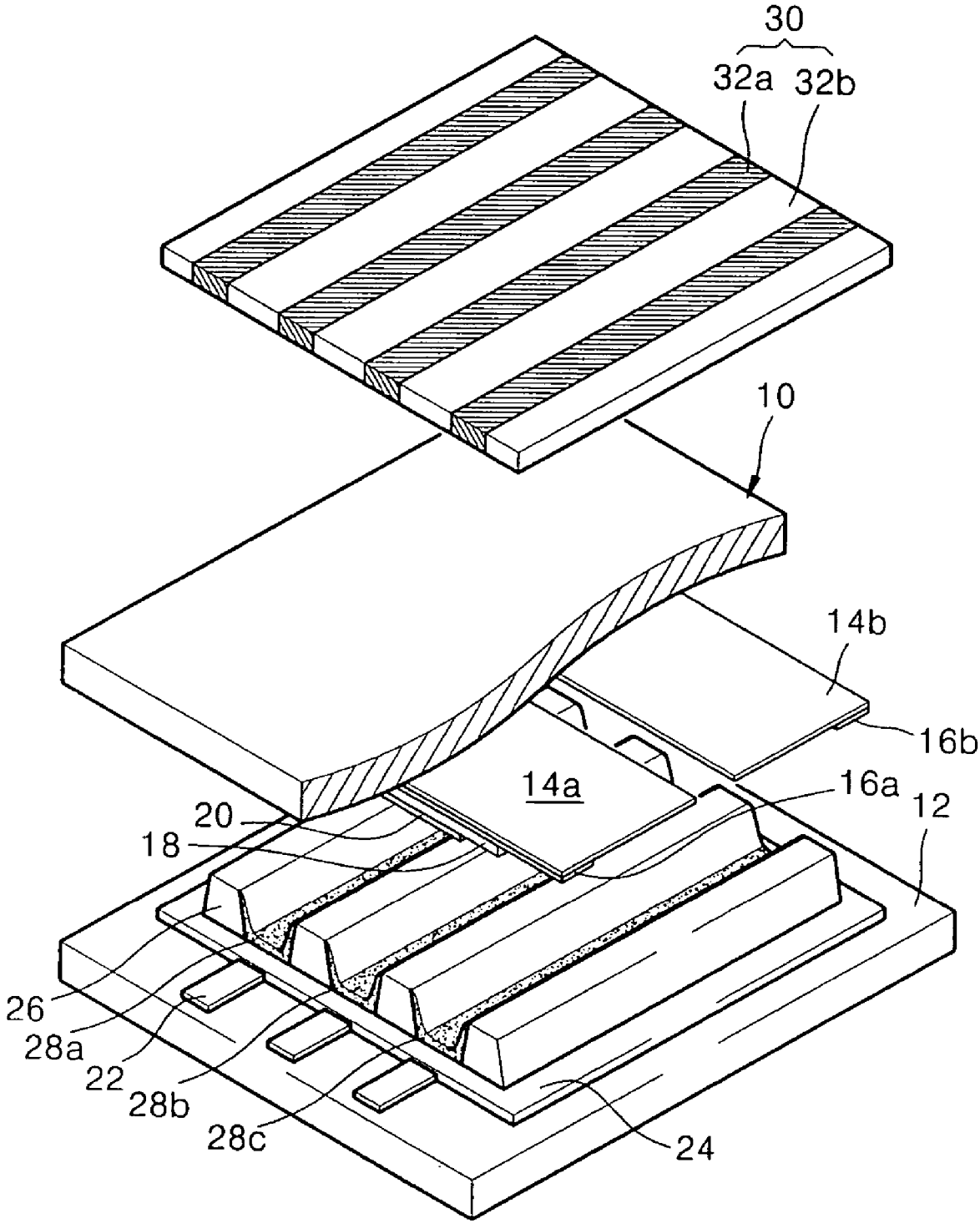
FIG. 1 (PRIOR ART)
FIG. 1 is an exploded perspective view of a conventional AC type PDP.
Figure 2:
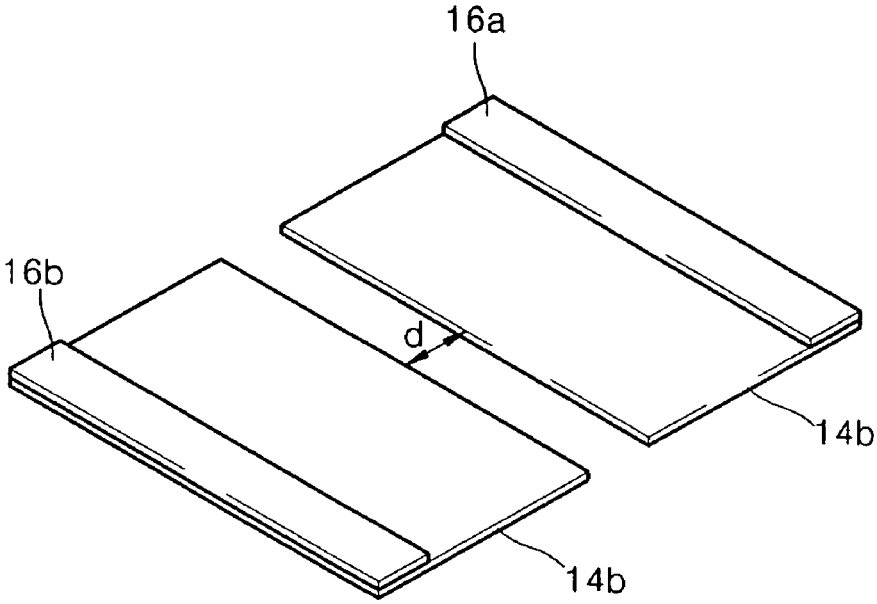
FIG. 2 (PRIOR ART)
FIG. 2 is a perspective view of the discharge sustaining electrodes and the bus electrodes shown in FIG. 1.
Figure 3:
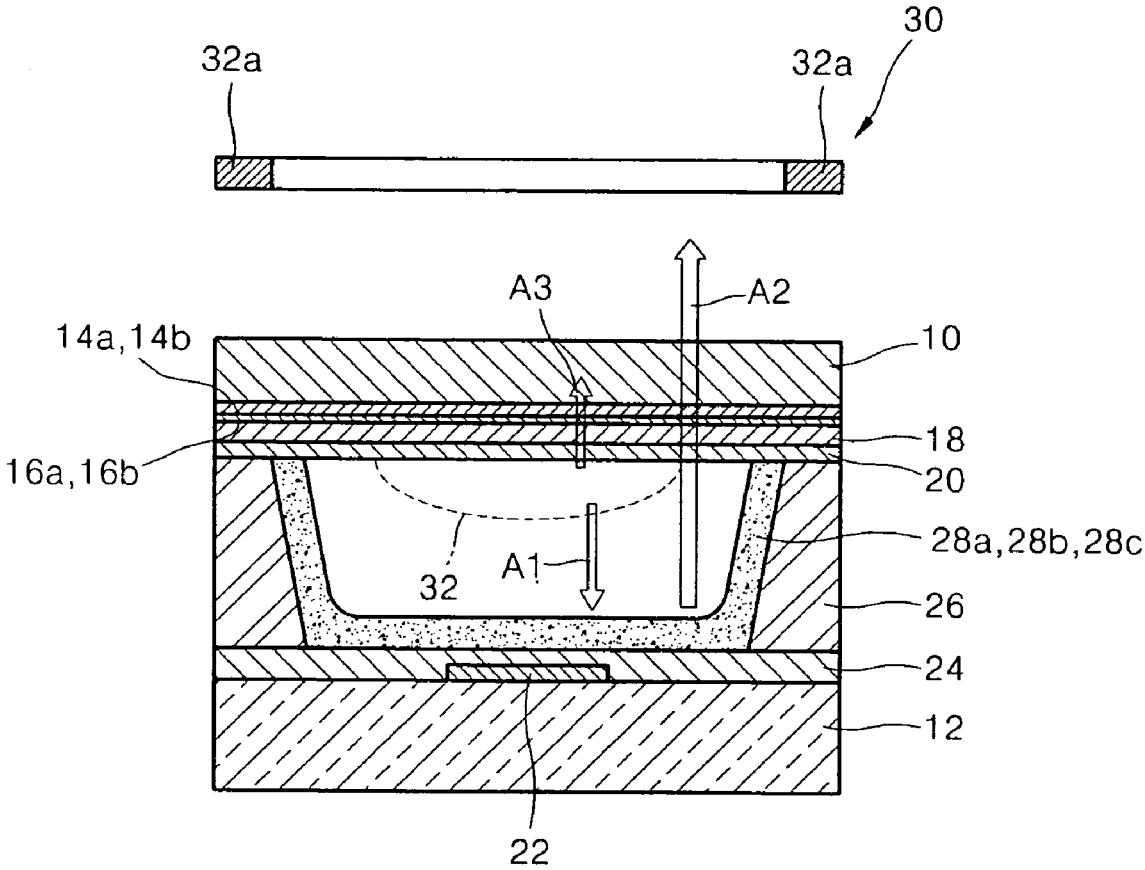
FIG. 3 (PRIOR ART)
FIG. 3 is a cross-section of the PDP of FIG. 1, taken in a direction perpendicular to the bus electrodes.

A PDP according to an embodiment of the present invention will now be described with reference to the accompanying drawings. In the drawings, the thicknesses of shown layers or regions are exaggerated for the clarity of the specification.

Figure 4:
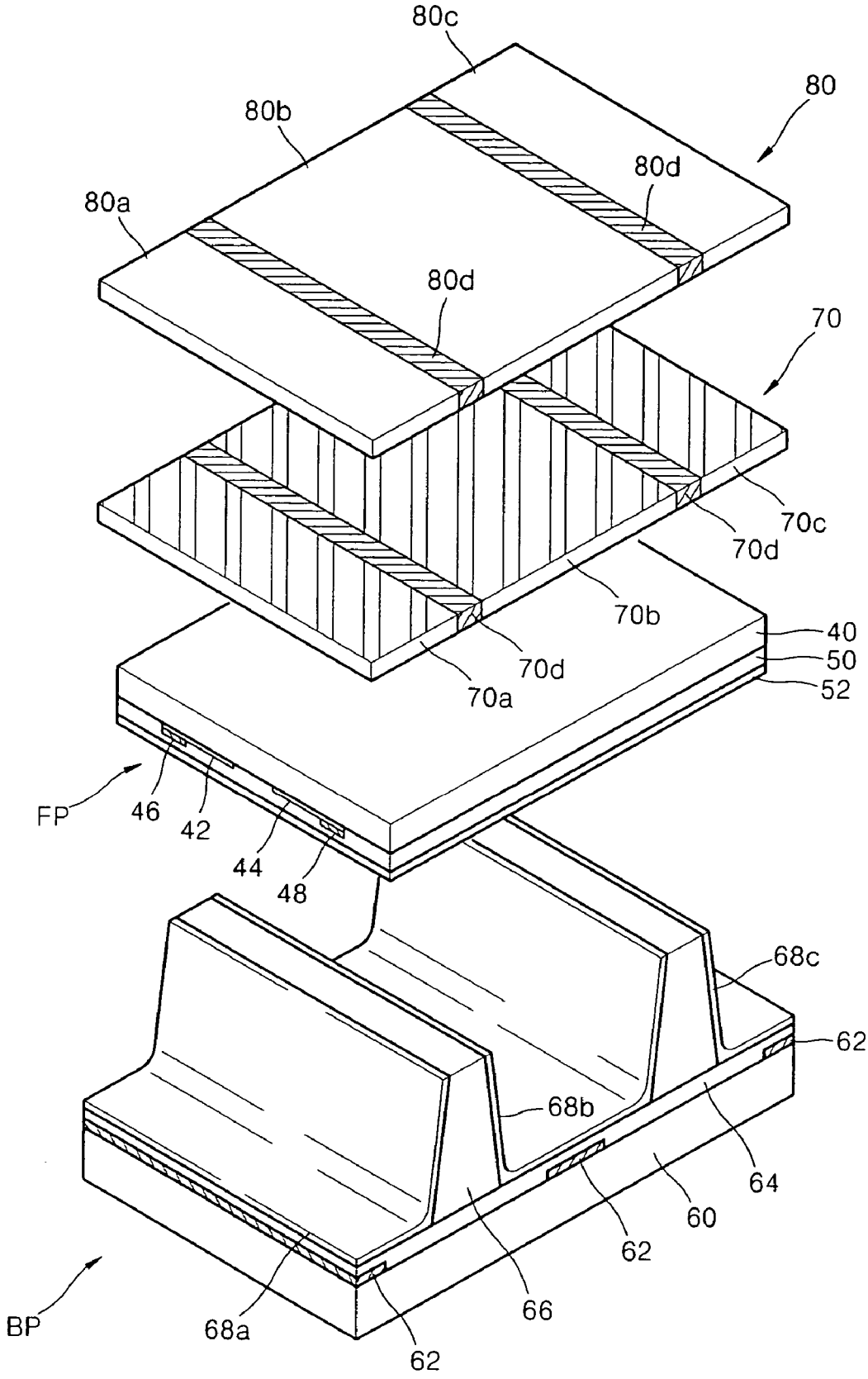
FIG. 4 is an exploded perspective view of a PDP according to an embodiment of the present invention which includes an optical converter between a filter set and a front panel.

Referring to FIG. 4, a PDP according to an embodiment of the present invention includes a front panel FP, a rear panel BP, an optical converter 70, and a filter set 80. The front and rear panels FP and BP face each other, and the optical converter 70 and the filter set 80 are installed over the front panel FP.

The front panel FP includes a front glass substrate 40, first and second discharge sustaining electrodes 42 and 44, first and second bus electrodes 46 and 48, a first dielectric layer 50, and a protective film 52. The front glass substrate 40 includes a first side, which faces a user, and a second side, which faces the rear panel BP. The first and second discharge sustaining electrodes 42 and 44 are formed on the second side of the front glass substrate 40 so that they are parallel to each other and isolated from each other. The first and second bus electrodes 46 and 48 are formed parallel to and on the first and second discharge sustaining electrodes 42 and 44, respectively. The first dielectric film 50 is formed on the second side of the front glass substrate 40 while covering the first and second bus electrodes 46 and 48 and the first and second discharge sustaining electrodes 42 and 44. The first dielectric layer 50 has a flat surface. The protective film 52 is formed on the surface of the first dielectric film 50.

The rear panel BP includes a rear glass substrate 60, address electrodes 62, a second dielectric layer 64, barrier ribs 66, and first through third fluorescent layers 68*a*, 68*b*, and 68*c*. The rear glass substrate 60 has a uniform thickness and has a third side, which faces the front panel FP, and a fourth side, which faces the opposite direction of the front panel FP. The address electrodes 62 are formed in parallel to one another on the third side of the rear glass substrate 60 at predetermined intervals. The second dielectric layer 64 is formed on the third side of the rear glass substrate 60 and has a flat surface. The address electrodes 62 are covered with the second dielectric layer 64. The barrier ribs 66 are formed in strips on portions of the second dielectric layer 64 that exist between adjacent address electrodes 62, so as to be parallel to the address electrodes 62. The barrier ribs 66 are formed to a predetermined height. The height of the barrier ribs 66 is an important factor that determines the interval between the barrier ribs 66 and a discharge cell region of a PDP. Two barrier ribs 66 define a discharge cell. Because one address electrode 62 is formed on the portion of the second dielectric layer 64 between barrier ribs 66, the numbers of address electrodes 62 and discharge cells included in the PDP are the same. The first, second, and third fluorescent layers 68*a*, 68*b*, and 68*c* are included in three discharge cells, respectively, that form a pixel unit. The first, second, and third fluorescent layers 68*a*, 68*b*, and 68*c* are coated on a surface of the second dielectric layer 64 between adjacent barrier ribs 66 and facing side surfaces of the barrier ribs 66, are excited by UV rays, and emit red (R), green (G), and blue (B) rays during stabilization. The first, second, and third fluorescent layers 68*a*, 68*b*, and 68*c* are excited by UV rays with wavelengths of at least 330 nm. Preferably, the first fluorescent layer 68*a* is an $Y_2O_2S$:Eu layer that emits R rays by being excited by UV rays, the second fluorescent layer 68*b* is a BAM($BaAl_{12}O_{19}$:Mn) layer that emits G rays, and the third fluorescent layer 68*c* is a BAM($BaMgAl_{10}O_{17}$:Eu) layer that emits B rays.

When the first, second, and third fluorescent layers 68*a*, 68*b*, and 68*c* are excited by UV rays with a wavelength of 330 nm or greater, the stokes efficiency of fluorescent substances is nearly double the stokes efficiency in the prior art when UV rays with a wavelength of 147 nm is used. Also, the transmittance with respect to the front panel FP increases.

Some of the UV rays produced in a discharge region of a PDP are directed upward the discharge region and penetrate the front panel FP. The optical converter 70 converts the UV rays transmitted by the front panel FP into visible rays to thus increase the luminance and luminous efficacy of the PDP. For example, the optical converter 70 can be a fluorescent plate that is composed of first, second, third fluorescent plates 70*a*, 70*b*, and 70*c* and first black strips 70*d*. The first, second, third fluorescent plates 70*a*, 70*b*, and 70*c* correspond to three discharge cells with the first, second, and third fluorescent layers 68*a*, 68*b*, and 68*c*, respectively. The first black strips 70*d* are formed between adjacent fluorescent plates of the first, second, and third fluorescent plates 70*a*, 70*b*, and 70*c* and correspond to the barrier ribs 66. The first black strips 70*d* prevent electronic wave interface between adjacent discharge cells, that is, UV rays or visible rays.

Since the first, second, and third fluorescent plates 70*a*, 70*b*, and 70*c* are supposed to convert UV rays emitted from a discharge region into visible rays, it is preferable that they are easily excited by the UV rays so as to emit visible rays. Also, because the first, second, and third fluorescent plates 70*a*, 70*b*, and 70*c* correspond to three discharge cells with the first, second, and third fluorescent layers 68*a*, 68*b*, and 68*c*, respectively, it is preferable that the first, second, and third fluorescent plates 70*a*, 70*b*, and 70*c* are formed of fluorescent materials that emit R, G, and B rays, respectively. Accordingly, it is more desirable that the first, second, and third fluorescent plates 70*a*, 70*b*, and 70*c* are formed of the fluorescent materials for the first, second, and third fluorescent layers 68*a*, 68*b*, and 68*c*. However, the first, second, and third fluorescent plates 70*a*, 70*b*, and 70*c* may be formed of other fluorescent materials. That is to say, the first fluorescent plate 70*a* is preferably a $Y_2O_2S$:Eu plate, and the second and third fluorescent plates 70*b* and 70*c* are preferably BAM plates. However, the first, second, and third fluorescent plates 70*a*, 70*b*, and 70*c* may be any fluorescent plates that can emit R, G, and B rays by UV rays with a wavelength of more than 330 nm, for example, organic photo-luminescent material dye plates. The optical converter 70 may be a film or powder, which will be described later.

The filter set 80 installed in front of the optical converter 70 is comprised of first, second, and third filters 80*a*, 80*b*, and 80*c* and second black strips 80*d* and blocks off the hazardous waves emitted from the above elements. The first, second, and third filters 80*a*, 80*b*, and 80*c* are located so as to face the first, second, and third fluorescent plates 70*a*, 70*b*, and 70*c*, and the second black strips 80*d* are located so as to face the first black strips 70*d*.

Figure 5:
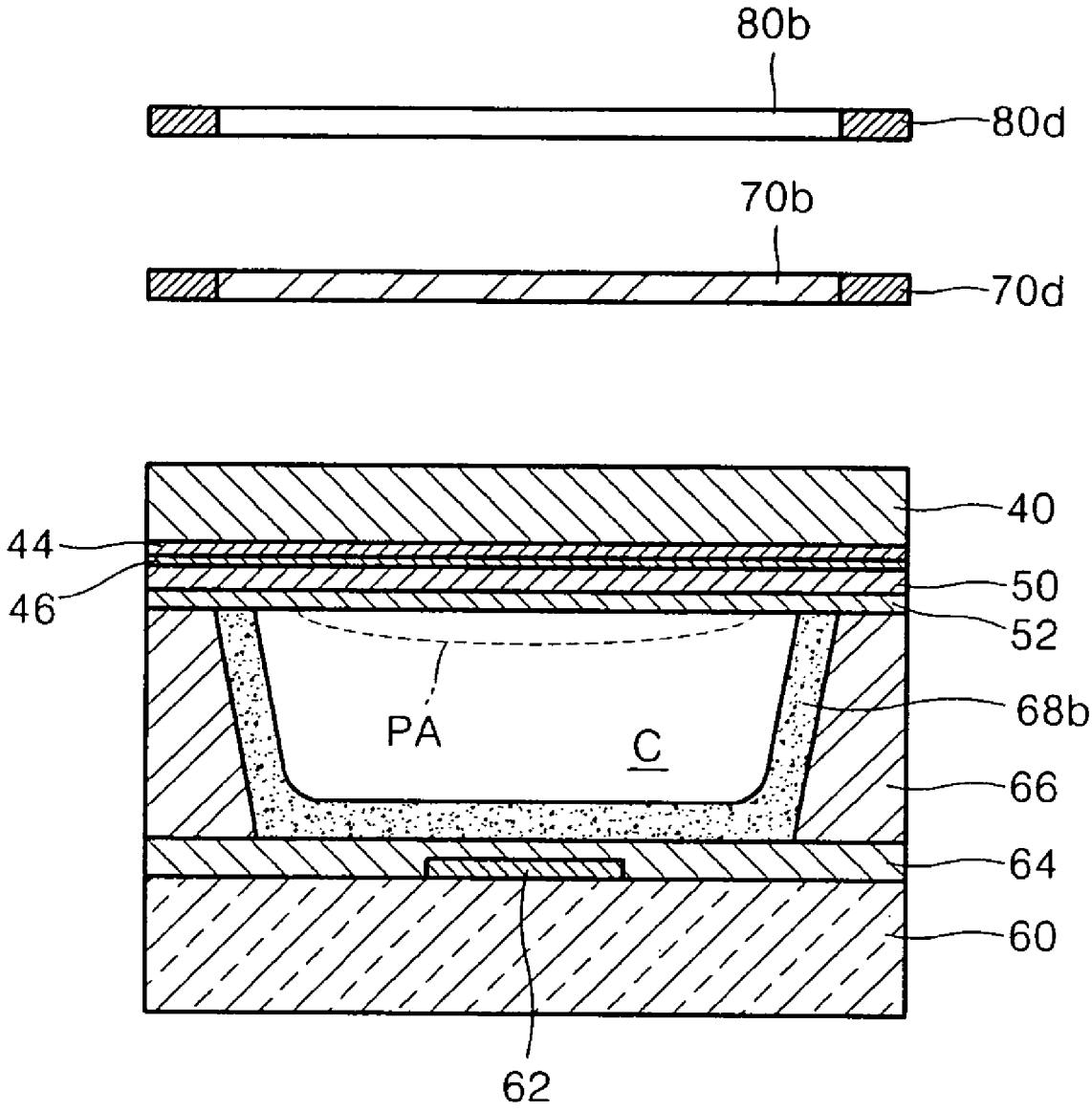
FIG. 5 is a partial cross-section of the PDP of FIG. 4, taken in the direction perpendicular to the address electrodes of FIG. 4.

FIG. 5 is a partial cross-section of the PDP of FIG. 4, taken in the direction perpendicular to the address electrodes 62. A cross-section of a discharge cell C having the second fluorescent layer 68*b* is shown in FIG. 5. In FIG. 5, reference character PA denotes an area for forming plasma. Because the plasma forming area PA is shown for convenience' sake, it must not be interpreted as being restricted as shown in FIG. 5.

PDPs according to other embodiments of the present invention will be described later with reference to FIG. 5. Hence, the contents of FIG. 5 are equally applied to the first and third fluorescent layers 68*a* and 68*c*.

Although not shown in FIG. 5, the discharge cell C is filled with a source gas for forming plasma. The source gas may be a gas that can emit UV rays with wavelengths of more than 330 nm during the formation of plasma, for example, a nitrogen ($N_2$) gas, a Xenon Fluoride (XeF*) gas, or the like. Preferably, the $N_2$ gas is used as the source gas. When the $N_2$ gas is used as the source gas, it is desirable that a proper amount of additional gas is used together with the $N_2$ gas. Preferable examples of the additional gas include a helium (He) gas, a neon (Ne) gas, an argon (Ar) gas, a krypton (Kr) gas, or a zenon (Xe) gas.

Figure 6:
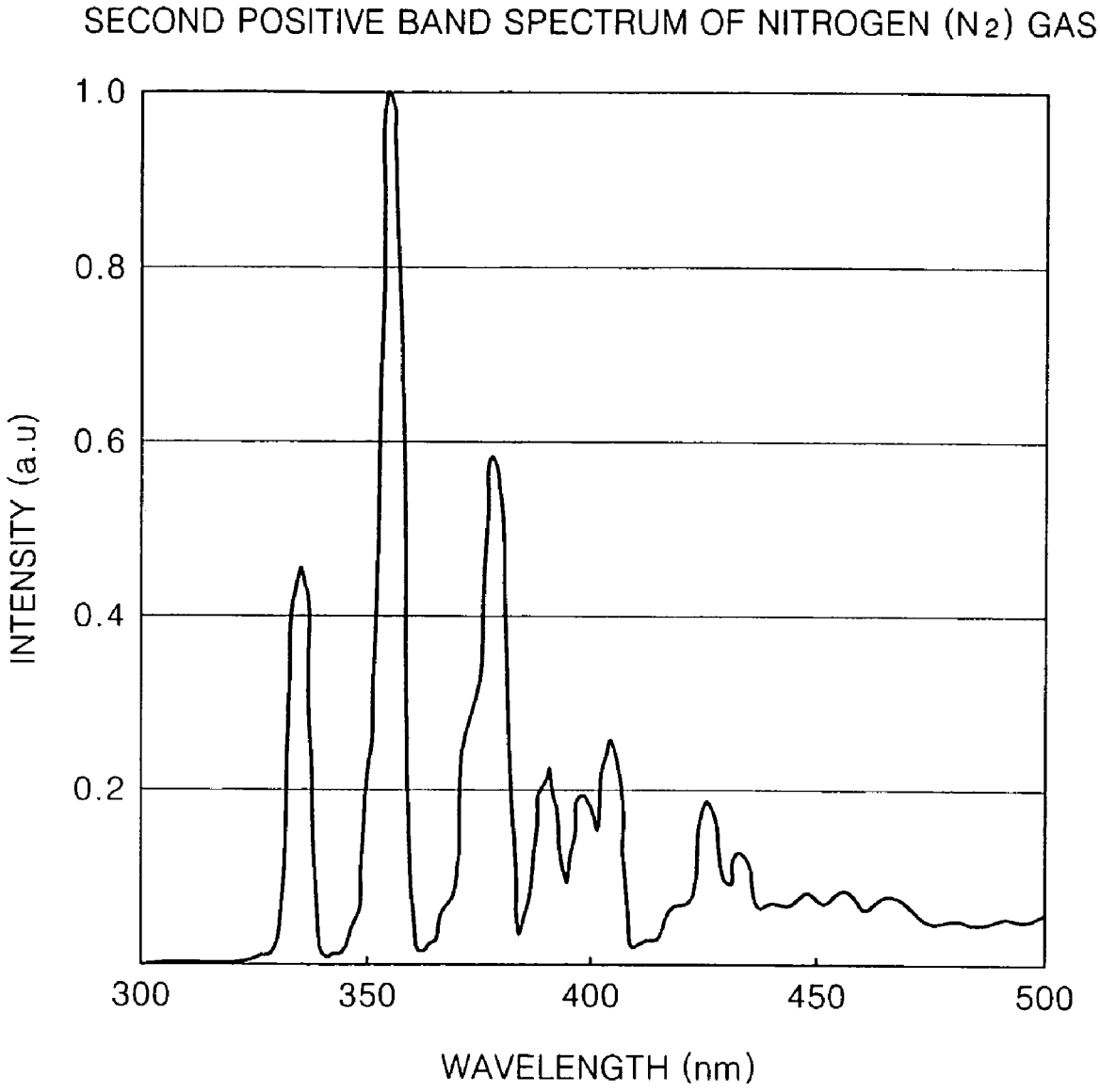
FIG. 6 is a graph showing a second positive band spectrum of a nitrogen gas used as a source gas for forming plasma on the PDP of FIG. 4.

FIG. 6 shows a second positive band spectrum of a $N_2$ gas. It can be seen from FIG. 6 that a $N_2$ gas has distinct intensities at 337 nm, 358 nm, and 381 nm wavelengths. Hence, when the $N_2$ gas is used as the source gas, UV rays with three wavelengths of more than 330 nm are emitted from the source gas during the formation of plasma.

Figure 7:
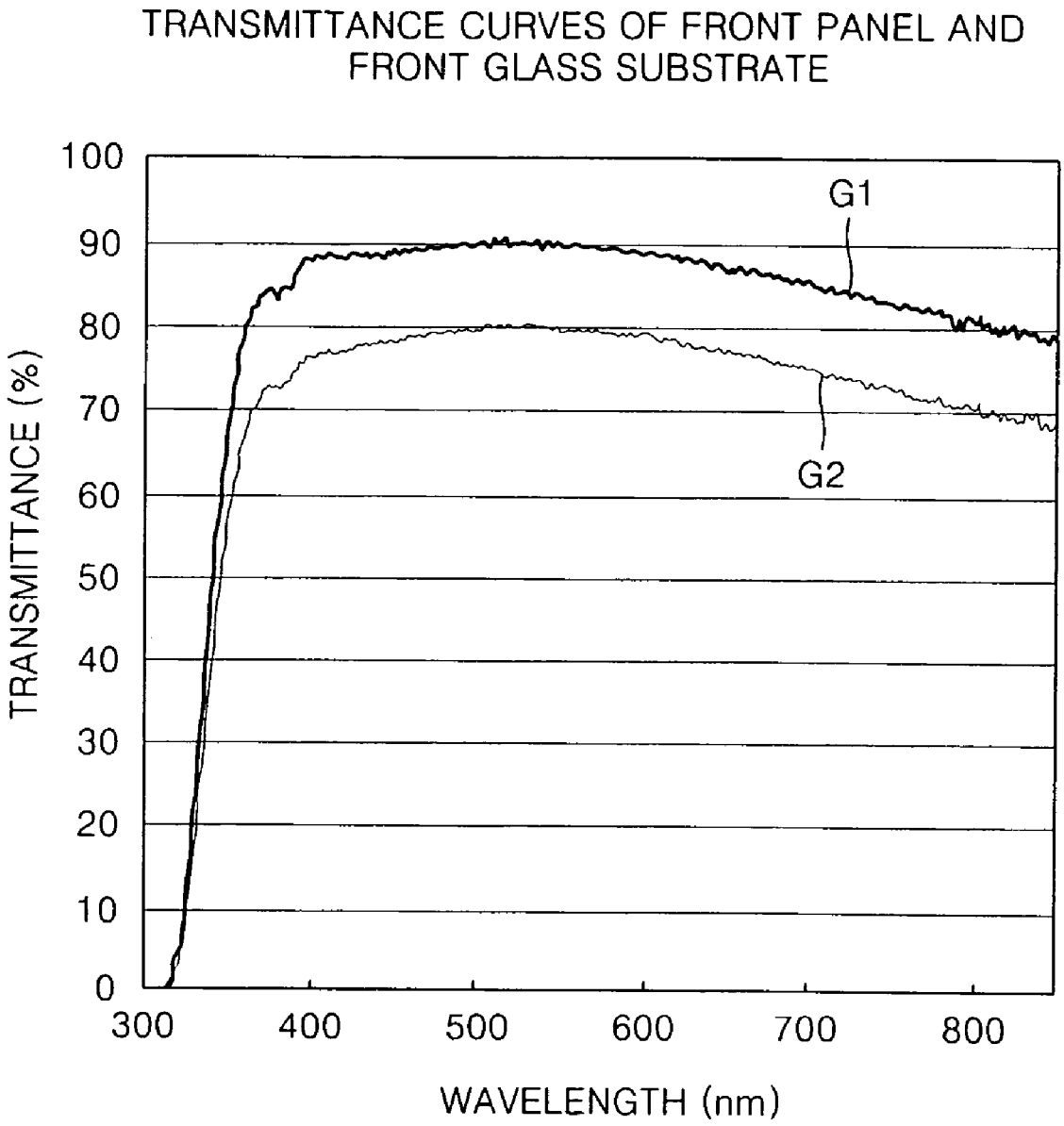
FIG. 7 is a graph showing a light transmittance of a front panel and a light transmittance of a front glass substrate of the PDP of FIG. 4.

FIG. 7 is a graph showing a light transmittance of the front panel FP and a light transmittance of the front glass substrate 40. A first curve G1 represents the light transmittance of the front glass substrate 40 with a 2.8 mm thickness, and a second curve G2 represents the light transmittance of the front panel FP.

Referring to the first and second curves G1 and G2, the front panel FP has a transmittance of about 31% with respect to 337 nm-wavelength UV rays (hereinafter, referred to as first UV rays), a transmittance of about 66% with respect to 358 nm-wavelength UV rays (hereinafter, referred to as second UV rays), and a transmittance of about 73% with respect to 381 nm-wavelength UV rays (hereinafter, referred to as third UV rays). Accordingly, it can be known that when the $N_2$ gas is used as the source gas, at least 31% of the UV rays emitted from the plasma forming area PA in the discharge cell C pass through the front panel FP.

This fact can be summarized as in Table 1.

TABLE 1

| Wavelength (nm) | Transmittance (%) |
|---|---|
| 337 | 31 |
| 358 | 66 |
| 381 | 73 |

Figure 8:
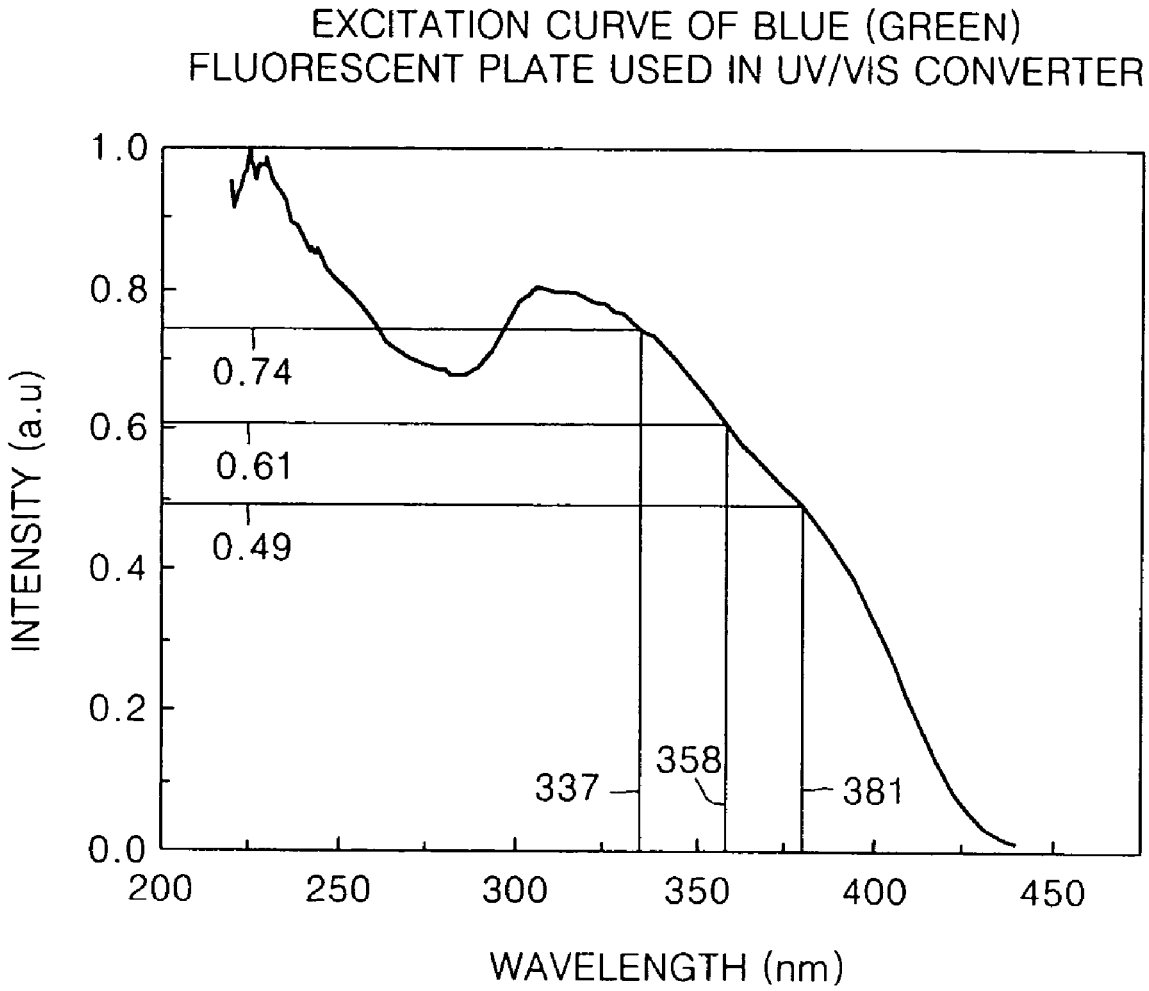
FIG. 8 is a graph showing an excitation curve of the second/third fluorescent plate excited by UV rays.

Hereinafter, excitation intensities of the first, second, and third fluorescent plates 70*a*, 70*b*, and 70*c* upon receipt of the first, second, and third UV rays transmitted by the front panel FP will be described with reference to FIGS. 8 and 9. FIG. 8 shows an excitation curve of the second (third) fluorescent plate 70*b* (70*c*) excited by UV rays.

Referring to FIG. 8, when the second (third) fluorescent plate 70*b* (70*c*) receives the first, second, and third UV rays, they excite 74%, 61%, and 49%, respectively, of the second (third) fluorescent plate 70*b* (70*c*).

Figure 9:
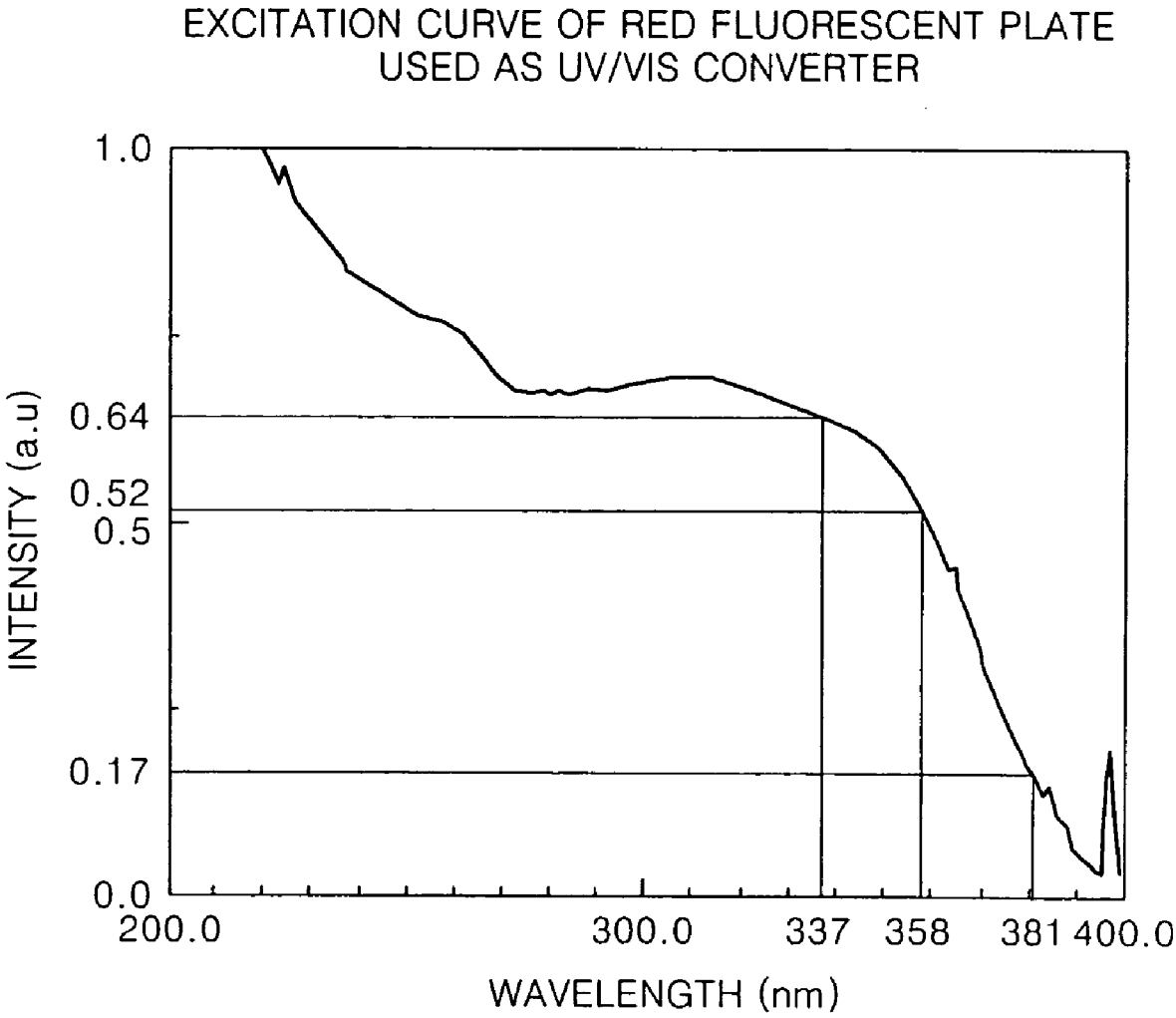
FIG. 9 is a graph showing an excitation curve of the first fluorescent plate excited by UV rays.

Referring to FIG. 9, excitation intensities of the first fluorescent plate 70*a* are 64%, 52%, and 17% with respect to the first, second, and third UV rays, respectively.

Because the first, second, and third fluorescent plates 70*a*, 70*b*, and 70*c* emit visible rays during stabilization after excitation, the excitation intensities of the first, second, and third fluorescent plates 70*a*, 70*b*, and 70*c* directly relate to the rates at which the first, second, and third UV rays are converted into visible rays by the first, second, and third fluorescent plates 70*a*, 70*b*, and 70*c*.

As described above, since the optical converter 70 including the first, second, and third fluorescent plates 70*a*, 70*b*, and 70*c* converts the UV rays transmitted by the front panel FP into visible rays, the overall amount of light that is emitted from the PDP and reaches a user is a sum of the visible rays (hereinafter, referred to as first visible rays) emitted from the first, second, and third fluorescent layers 68*a*, 68*b*, and 68*c* and the visible rays (hereinafter, referred to as second visible rays) emitted by the first, second, and third fluorescent plates 70*a*, 70*b*, and 70*c*. In other words, the PDP according to the present invention enables a greatly increased amount of visible light to reach a user, as compared to conventional PDPs in which only the first visible rays reach to a user. As a result, the luminance of the PDP according to the present invention is increased.

Some of the first visible rays are lost while passing through the optical converter 70 installed in front of the front panel FP. Hence, the number of first visible rays transmitted by the optical converter 70 measures smaller than the number of first visible rays measured when the optical converter 70 is not installed. Thus, it is preferable that the number of second visible rays emitted from the optical converter 70 is greater than the number of first visible rays lost by the optical converter 70.

As described above, because the optical converter 70 relates to both the loss of the first visible rays and the emission of the second visible rays, the optical converter 70 preferably has a physical property (e.g., a thickness) that enables to increase the overall amount of light that is emitted from a PDP and reaches a user as compared to conventional PDPs.

The amount of first visible rays lost by the optical converter 70 can be ascertained by referring to the transmittance of the first visible rays with respect to the optical converter 70. The range of an appropriate thickness of the optical converter 70 is also determined by referring to the transmittance of the first visible rays with respect to the optical converter 70.

Figure 10:
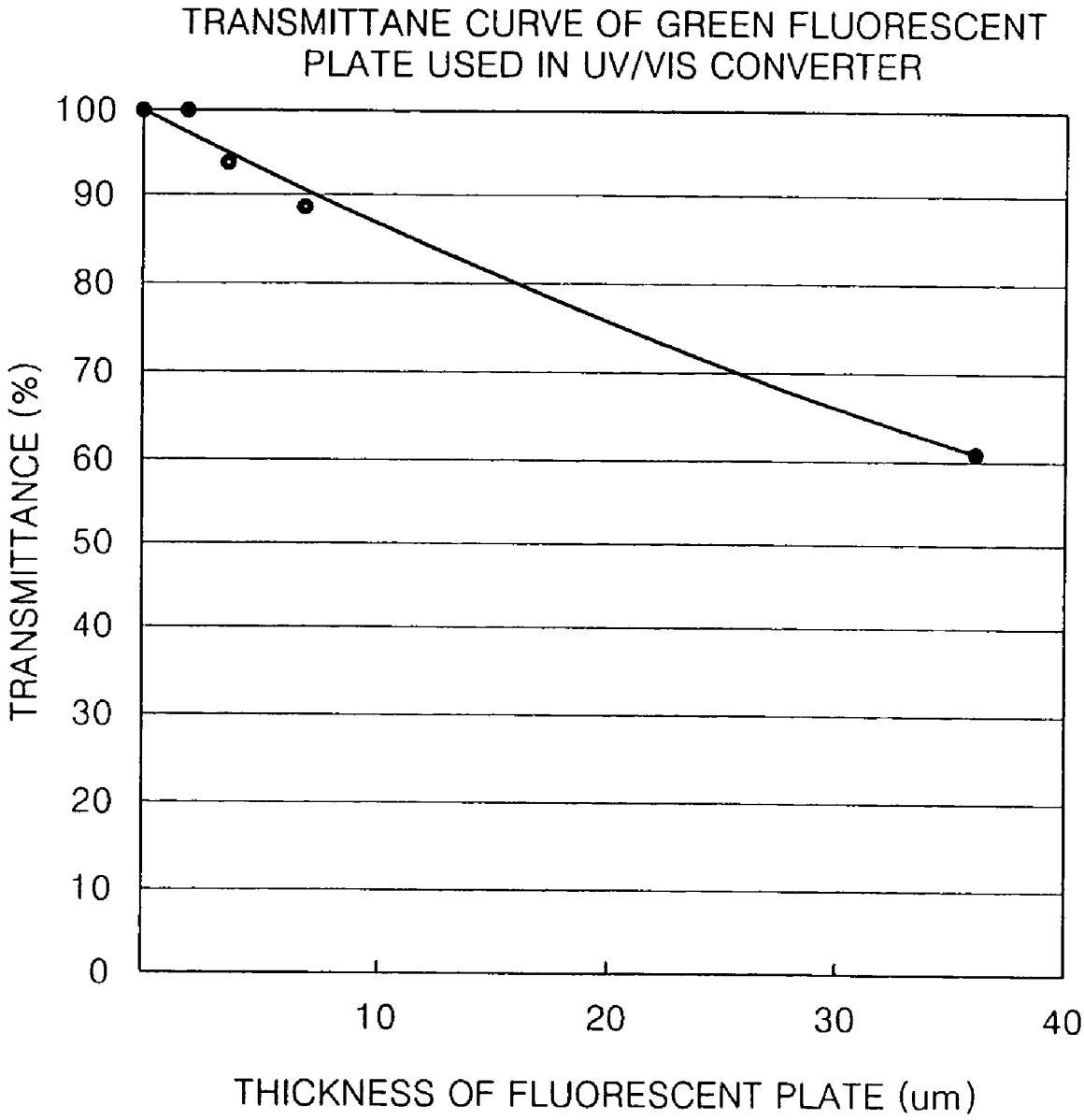
FIG. 10 is a graph showing a transmittance of green (G) light versus the thickness of an optical converter.

To be more specific, FIG. 10 shows a transmittance of G rays versus the thickness of the second fluorescent plate 70*b*. Although transmittance variations (not shown) of R and B rays according to the thicknesses of the first and third fluorescent plates 70*a* and 70*c*, respectively, are similar to the transmittance variation of G visible rays of FIG. 10, they are slightly different in transmittance value. Table 2 shows the tendency of transmission variations of the R, G, and B rays according to the thickness of each of the first, second, and third fluorescent plates 70*a*, 70*b*, and 70*c*.

| Thickness (μm) of each of first, second, and third fluorescent plates | Transmittance (%) of each of R, G, and B rays |
|---|---|
| 0 | 100 |
| 2 | 97 |
| 4 | 95 |
| 6 | 92 |
| 8 | 89 |
| 10 | 87 |
| 15 | 81 |
| 20 | 76 |

Referring to FIG. 10 and Table 2, it can be seen that the tendency of the transmittance variations of the R, G, and B rays with respect to the first, second, and third fluorescent plates 70*a*, 70*b*, and 70*c* is equal.

<Thickness Range of the Third Fluorescent Plate 70*c*>

Since the luminance of B rays among the first visible rays transmitted by the front panel FP is 76.8 cd/m$^2$, and the luminance of B rays among the second visible rays is 30.9 cd/m$^2$, the overall luminance of the B rays detected in front of the optical converter 70 must be greater than 76.8 cd/m$^2$, which is the luminance of the B rays among the first visible rays transmitted by the front panel FP. This condition is hereinafter referred to as a third condition. The overall luminance of the B light in front of the optical converter 70 is given by Inequality 1:

$$76.8\ \text{cd/m}^2 < 30.9\ \text{cd/m}^2 + T3 \times 76.8\ \text{cd/m}^2 \quad (1)$$

wherein T3 denotes a transmittance of the B rays among the first visible rays with respect to the third fluorescent plate 70*c*. The transmittance T3 is hereinafter referred to as a third transmittance. The third transmittance T3 satisfies the third condition and is obtained from Inequality 1.

The third transmittance T3 is given by Inequality 2:

$$T3 > 60\% \quad (2)$$

Preferably, the thickness of the third fluorescent plate 70*c* is less than 37 μm. In other words, the thickness (t) of the third fluorescent plate 70*c* is given as 0 μm<t<37 μm, preferably, 5 μm≦t<37 μm.

<Thickness Range of the Second Fluorescent Plate 70*b*>

Since the luminance of G rays among the first visible rays transmitted by the front panel FP is 78.8 cd/m$^2$, and the luminance of G rays among the second visible rays is 30.9 cd/m$^2$ like the luminance of B rays among the second visible rays, the overall luminance of G rays detected in front of the optical converter 70 must be greater than 78.8 cd/m$^2$, which is the luminance of G rays among the first visible rays transmitted by the front panel FP. This condition is hereinafter referred to as a second condition. The overall luminance of the G rays detected in front of the optical converter 70 is given by Inequality 3:

$$78.8\ \text{cd/m}^2 < 30.9\ \text{cd/m}^2 + T2 \times 78.8\ \text{cd/m}^2 \quad (3)$$

wherein T2 denotes a transmittance of the G rays among the first visible rays with respect to the second fluorescent plate 70*b*. The transmittance T2 is hereinafter referred to as a second transmittance. The second transmittance T2 satisfies the second condition and is obtained from Inequality 3.

The second transmittance T2 is given by Inequality 4:

$$T2 > 61\% \quad (4)$$

Referring to Inequality 4 and FIG. 10 showing the second transmittance T3 versus the thickness of the second fluorescent plate 70*b*, the thickness of the second fluorescent plate 70*b* is preferably less than 36 μm. In other words, the thickness (t) of the second fluorescent plate 70*b* is given as 0 μm<t<36 μm, preferably, 5 μm≦t<36 μm.

As described above, because the thickness ranges of the second and third fluorescent plates 70*b* and 70*c* are almost the same, the second and third fluorescent plates 70*b* and 70*c* preferably have the same thickness.

<Thickness Range of the First Fluorescent Plate 70*a*>

Since the luminance of R rays among the first visible rays transmitted by the front panel FP is 60.1 cd/m$^2$, and the luminance of R rays among the second visible rays is 22.8 cd/m$^2$, the overall luminance of R rays detected in front of the optical converter 70 must be greater than 60.1 cd/m$^2$, which is the luminance of R rays among the first visible rays transmitted by the front panel FP. This condition is hereinafter referred to as a first condition. The overall luminance of R rays existing in front of the optical converter 70 is given by Inequality 5:

$$60.1\ \text{cd/m}^2 < 22.8\ \text{cd/m}^2 + T1 \times 60.1\ \text{cd/m}^2 \quad (5)$$

wherein T1 denotes a transmittance of the R rays among the first visible rays with respect to the first fluorescent plate 70*a*. The transmittance T1 is hereinafter referred to as a first transmittance. The first transmittance T1 satisfies the first condition and is obtained from Inequality 5.

The first transmittance T1 is given by Inequality 6:

$$T1 > 62\% \quad (6)$$

The thickness of the first fluorescent plate 70*a* is preferably less than 35 μm in order to satisfy Inequality 6. In other words, the thickness (t) of the first fluorescent plate 70*a* is given as 0 μm<t<35 μm, preferably, 5 μm≦t<35 μm.

As described above, the thicknesses of the first, second, and third fluorescent plates 70*a*, 70*b*, and 70*c* must be thinner than 35 μm, 36 μm, and 37 μm, respectively, in order to make the overall luminance of light detected in front of the optical converter 70 be greater than the luminance of light transmitted by the front panel FP. Accordingly, the thicknesses of the first, second, and third fluorescent plates 70*a*, 70*b*, and 70*c* may be different, but are preferably set to be equal to one another in consideration of a PDP manufacturing process and the like. In other words, preferably, the first, second, and third fluorescent plates 70*a*, 70*b*, and 70*c* have an identical thickness that is less than 35 μm.

Modifications of the PDP according to an embodiment of the present invention of FIG. 4 will now be described with reference to FIGS. 11 and 12.

Figure 11:
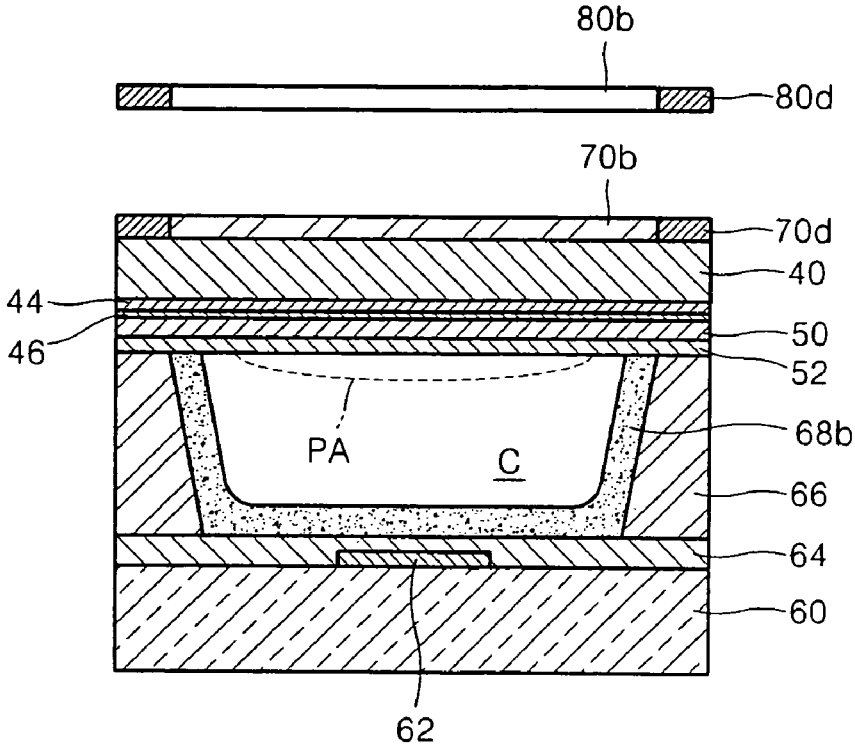
FIGS. 11 and 12 are cross-sections of modifications of the PDP of FIG. 5.
Figure 12:
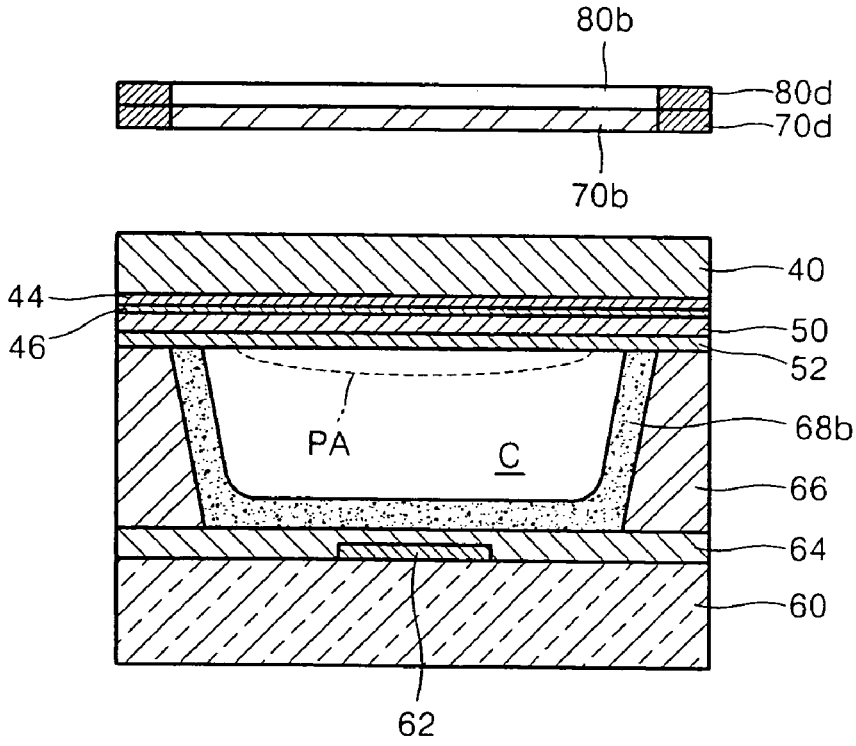

To be more specific, although the optical converter 70 in the PDP of FIG. 4 is provided between the front panel FP and the filter set 80 as shown in FIG. 5, the optical converter 70 may be attached to the front surface of the front panel FP, that is, the first side of the front glass substrate 40, as shown in FIG. 11. Alternatively, as shown in FIG. 12, the optical converter 70 may be attached to a surface of the filter set 80 that faces the first side of the front glass substrate 40.

As described above, when the optical converter 70 is attached to the filter set 80 or the first side of the front glass substrate 40, the optical converter 70 may be a film or powder.

Although not shown in the drawings, instead of the optical converter 70, the filter set 80 itself may be used as a converter for converting UV rays into visible rays. In other words, the filter set 80 can be constructed so as to perform its unique function, that is, an interception of UV rays, EMI, and the like, and also to convert the UV rays transmitted by the front panel FP into visible rays. The thus-constructed filter set 80 may be attached to the front panel FP.

As described above, a PDP according to the present invention includes an optical converter which is installed between a front panel and a filter set to convert received UV rays into visible rays. Hence, the overall amount or luminance of light detected in front of the optical converter is greater than when no optical converters are installed. Also, the PDP according to the present invention can increase the efficiency.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, one of skill in the art may incorporate the optical converter 70 with the filter set 80 instead of attaching the former to the latter. Also, one of skill in the art may form the optical converter 70 with a plurality of thin layers isolated from each other at predetermined intervals while keeping the thickness set out in the embodiment, instead of a single layer.

What is claimed is:

1. A plasma display panel, comprising:

a front substrate having a front surface and a rear surface;

a rear substrate facing the rear surface of the front substrate;

a plurality of barrier ribs to divide space between the front substrate and the rear substrate into a plurality of discharge cells;

a fluorescent layer formed on side walls of the barrier ribs;

a gas disposed in the discharge cell, the gas being changed into plasma during operation;

an optical converter positioned over the front surface of the front substrate; and a filter set positioned over said optical converter, wherein said plasma generates ultraviolet (UV) rays, a first portion of the UV rays passing through said front substrate and thence being converted into first visible rays by said optical converter, a second portion of the UV rays being converted into second visible rays by said fluorescent layer, said second visible rays passing through said front substrate and said optical converter, and wherein said first and second visible rays pass through said filter set, wherein the optical converter is a fluorescent material formed by combining red, green, and blue fluorescent segments that emit red, green, and blue visible rays, respectively, and wherein when the thickness of the fluorescent segments is t, the thickness of the red fluorescent segment is in the range of 5 μm<t<35 μm, the thickness of the green fluorescent segment is in the range of 5 μm<t<36 μm, and the thickness of the blue fluorescent segment is in the range of 5 μm<t<37 μm. these thicknesses being different from each other.

2. The plasma display panel of claim 1, wherein the optical converter is attached to said front surface of the front substrate.

3. The plasma display panel of claim 1, wherein the optical converter is attached to the back of the filter set.

4. The plasma display panel of claim 1, wherein the fluorescent material is able to convert ultraviolet rays with a wavelength of longer than 330 nm into visible rays.

5. The plasma display panel of claim 1, wherein the red fluorescent plate is an $Y_2O_2S$:Eu plate, and each of the green and blue fluorescent plates includes a $BaAl_{12}O_{19}$:Mn plate for emitting green light, and a $BaMgAl_{10}O_{17}$:Eu plate for emitting blue light.

6. The plasma display panel of claim 1, wherein the fluorescent material is an organic photo-luminescent material.

7. The plasma display panel of claim 1, wherein the optical converter is a fluorescent film.

8. The plasma display panel of claim 1, wherein the optical converter is a fluorescent plate.

9. A plasma display panel comprising:

a rear panel;

a front panel;

a plurality of ribs between said front and rear panels and defining spaces therebetween wherein plasma generates ultraviolet (UV) rays;

a fluorescent layer on at least one of the side walls of the ribs and the rear panel;

an optical converter positioned over a surface of the front panel on a side opposite to said spaces;

a filter set located on a side of said optical converter opposite to said front panel;

wherein said plasma generates ultraviolet (UV) rays, a first portion of the UV rays passing through said front substrate and thence being converted into first visible rays by said optical converter, a second portion of the UV rays being converted into second visible rays by said fluorescent layer, said second visible rays passing through said front substrate and said optical converter, and wherein said first and second visible rays pass through said filter set, wherein the optical converter is a fluorescent material formed by combining red, green, and blue fluorescent segments that emit red, green, and blue visible rays respectively, and wherein when the thickness of the fluorescent segments is t, the thickness of the red fluorescent segment is in the range of 5 μm<t<35 μm, the thickness of the green fluorescent segment is in the range of 5 μm<t<36 μm, and the thickness of the blue fluorescent segment is in the range of 5 μm<t<37 μm, these thicknesses being different from each other.

* * * * *